US005387779A

United States Patent [19]

Suzuki

[11] Patent Number: 5,387,779

[45] Date of Patent: Feb. 7, 1995

[54] RICE OVEN WITH FORCED RESIDUAL HEAT EXHAUST

[76] Inventor: Kisaku Suzuki, 19-8, Toshida, 1-chome, Nerima-ku, Tokyo, Japan

[21] Appl. No.: 148,625

[22] Filed: Nov. 8, 1993

[51] Int. Cl.[6] ..... A21B 1/00; A21B 1/22

[52] U.S. Cl. ..... 219/400; 219/394

[58] Field of Search ..... 219/400, 399, 391, 394, 219/405, 411, 401; 373/8, 110; 432/48, 200; 454/339; 126/21 R; 426/523, 241-243, 248; 99/483, 451, 467; 392/416

[56] References Cited

U.S. PATENT DOCUMENTS

| | | | |
|---|---|---|---|
| 2,549,619 | 4/1951 | Miskella | 392/416 |
| 4,113,439 | 9/1978 | Ookubo et al. | 219/391 |
| 4,627,409 | 12/1986 | Kagomoto | 219/400 |
| 4,865,010 | 9/1989 | Kett | 219/391 |
| 4,978,295 | 12/1990 | Vukovich, Jr. | 219/400 |

FOREIGN PATENT DOCUMENTS

| | | | |
|---|---|---|---|
| 154595 | 9/1985 | European Pat. Off. | 219/400 |
| 330727 | 9/1989 | European Pat. Off. . | |
| 56-53320 | 5/1981 | Japan | 219/400 |
| 57-131939 | 8/1982 | Japan | 219/400 |
| 59-44528 | 3/1984 | Japan . | |
| 60-27866 | 2/1985 | Japan . | |
| 2-178527 | 7/1990 | Japan | 219/399 |

*Primary Examiner*—Philip H. Leung
*Assistant Examiner*—John A. Jeffery
*Attorney, Agent, or Firm*—Lowe, Price, LeBlanc & Becker

[57] ABSTRACT

An electric rice oven which can prevent rice from scorching and producing a fluffy, tasty and delicious rice comprising an electrical heater arranged in the lower part of an oven body, exhaust outlets in the upper part of said oven body, and a vent hole 25 adjacent said heater for decreasing residual heat on the inside of the oven body.

1 Claim, 3 Drawing Sheets

RICE OVEN WITH FORCED RESIDUAL HEAT EXHAUST

BACKGROUND OF THE INVENTION

1. Field of the Invention

The present invention relates to an electric rice oven.

2. Description of the Related Art

For cooking, rice, adjustment of the water, soaking of the rice in water, and the way of heating and steaming just after the rice is boiled are important.

In order to cook delicious rice, the rice starch in the rice grain has to be made to undergo a-conversion, and accordingly, it is said that the rice is required to be heated at a temperature higher than 90 deg. C. for at least 20 min. Further, the steaming time of the rice just after boiling becomes a key point for enhancing the taste and gloss of the rice.

Recently, gas type rice ovens using gas as a heat source and electric type rice ovens using electricity as a heat source have been available. FIG. 5 shows the boiling point reaching/cooling time characteristic (a) of a gas type rice oven and that (b) of an electric type rice oven. As understood from the figure, the boiling point reaching time and the cooling time using a gas type rice oven are both short, but those of an electric type rice oven are long, that is, the residual heat of an electrical type oven is long as compared with gas type one.

By the way, an existing electric rice oven has an exhaust system in which an exhaust hole formed in the rear wall or the like of the inside of the oven communicates with an external exhaust pipe, and which discharges steam outside during cooking.

However, in the above-mentioned conventional electric rice oven, it is a structure only for discharging steam generated during cooking to the outside through the exhaust hole and the exhaust pipe by natural convection. Accordingly, for example, if rice is steamed at about 120 deg. C. after it is heated and boiled at 100 deg. C., the temperature of the inside of the oven rises up immediately to around 150 deg. C. so that the residual heat existing time becomes long, and that the evaporation of moisture is rapidly carried out, which results in the moisture becoming less so that the rice scorches and sticks to the cooking pot or a net during steaming, and accordingly, a loss of cooking rice corresponding to for example, 20 to 30% occurs. Further, when the degree of the scorching increases a smoky smell remains and the taste and flavor are deteriorated.

SUMMARY OF THE INVENTION

The present invention was devised in view of problems inherent in the above-mentioned conventional technology, and an object of the present invention is to provide an electric type rice oven which makes it possible to cook soft and fluffy and delicious rice without scorching and without loss by making the oven structure so that residual heat inside of the oven is decreased at once after the boiling of the rice and by lowering rapidly the temperature of the inside of the oven.

To achieve this object, the rice oven of the present invention is characterized in that; a vent hole for deaerating residual heat is provided on an oven body with an electrical heater, and the residual heat in the oven body is forcibly deaerated to the outside by a fan, pump or the like.

With this arrangement, after a predetermined quantity of washed rice and water have been put into a cooking pot and soaked for a predetermined time, the cooking pot is put into the oven whose door is opened.

At this time, by setting a flange part projecting outward from the upper edge of the cooking pot on the guide rails facing each other to the upper part of right and left inside wall surfaces of the oven body, and by pushing the cooking pot into the oven body, the cooking pot taken in the oven body.

A control panel an the front surface of the oven body is provided with a power source switch, a power source lamp, a cooking switch, a cooking lamp, a reservation timer, a reservation lamp, a steaming lamp and a buzzer switch.

After closing the door, when a power switch is turned on, the electrical healer at the bottom of the oven body is energized, Next, after the buzzer switch is turned on, when the cooking switch is turned on, the cooking lamp is lit.

By the generation of heat of the heater at the bottom of the oven body, the rice in the cooking pot is heated at a predetermined temperature and is cooked.

When the cooking lamp indicates that the completion of the cooking of the rice is finished, the steaming lamp is lit and it inters the steaming process.

After completion of the cooking, if the operation of the fan, pump or the like is started at once, the residual heat in the oven body is forcibly removed to the outside through the vent hole, and the temperature of the inside of the oven abruptly drops and is controlled at a value (about 120 deg. C.) suitable for the steaming of the rice, so that excessive evaporation of moisture is restrained, and thereby it is possible to prevent the rice from being scorched.

As a system for the forced removal of the residual heat, a suction system or blow-in system by fan or the like is used.

In the suction system, the residual heat is sucked away and removed to the outside as it is. On the contrary, in a blow-in system, by sucking ambient air into the oven body through a vent hole, the residual heat in the oven body is forcibly decreased through existing exhaust hole and exhaust pipe.

After the steaming time (about 30 min.) elapses, the steaming lamp is extinguished, and simultaneously a buzzer is energized. The buzzer is deenergized when the buzzer switch is turned off.

When the cooking control is to be set, the time of cooking is determined at first, and then the control timer is set.

These and other objects, advantages, features and uses of the invention will become apparent from the following description of the preferred embodiments taken in conjunction with the accompanying drawings.

DESCRIPTION OF THE PREFERRED EMBODIMENTS

Figure 1:
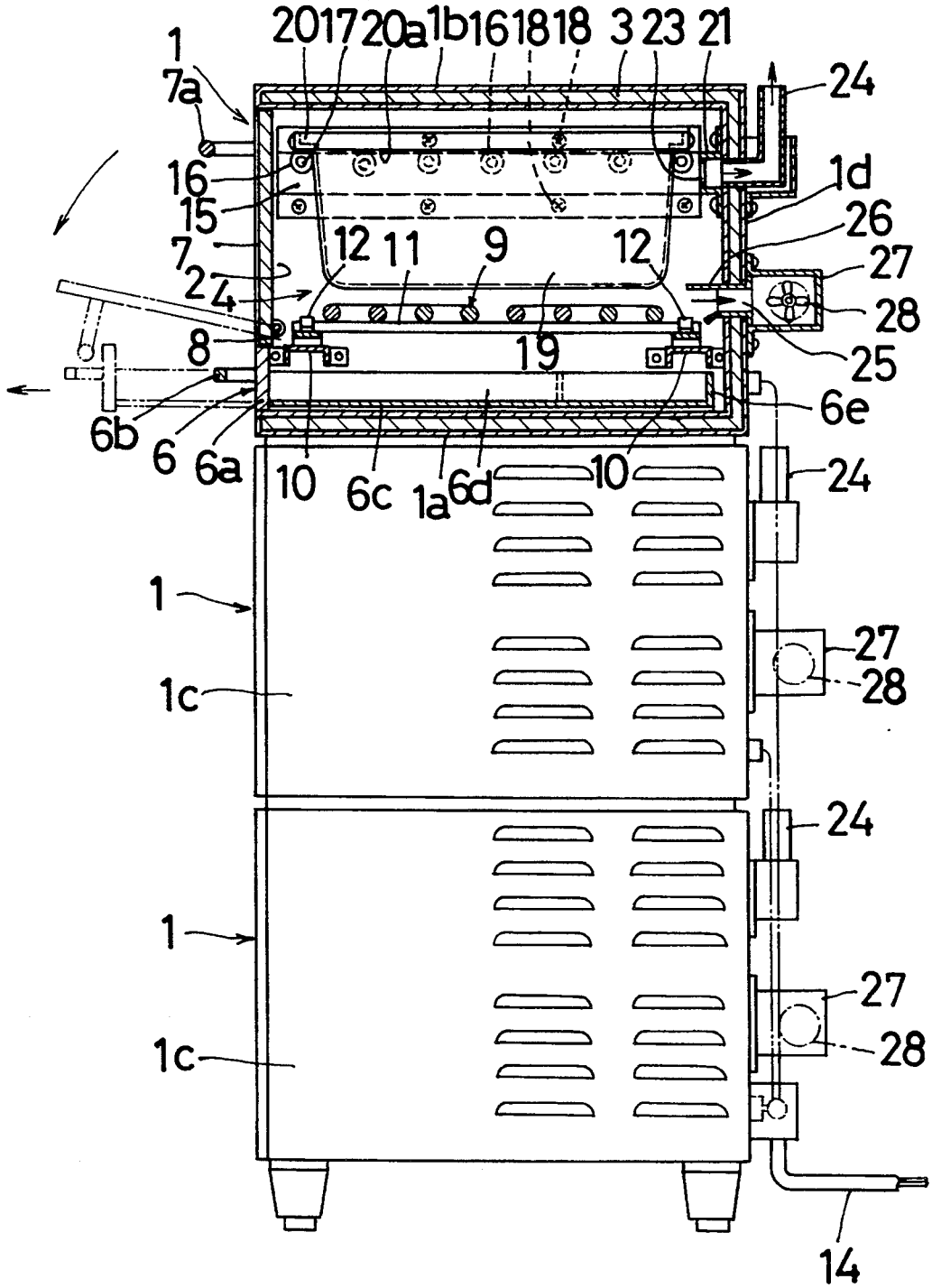
FIG. 1 is a partly broken side view showing an embodiment of a rice oven according to the present invention.
Figure 2:
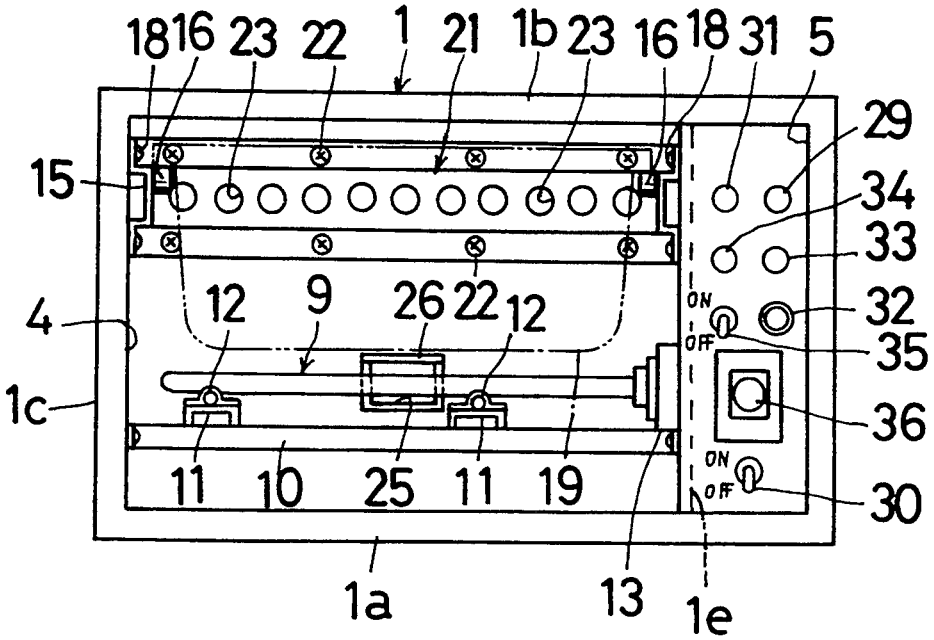
FIG. 2 is a front view snowing an embodiment of the rice oven itself by removing a door and a receiving pan.
Figure 4:
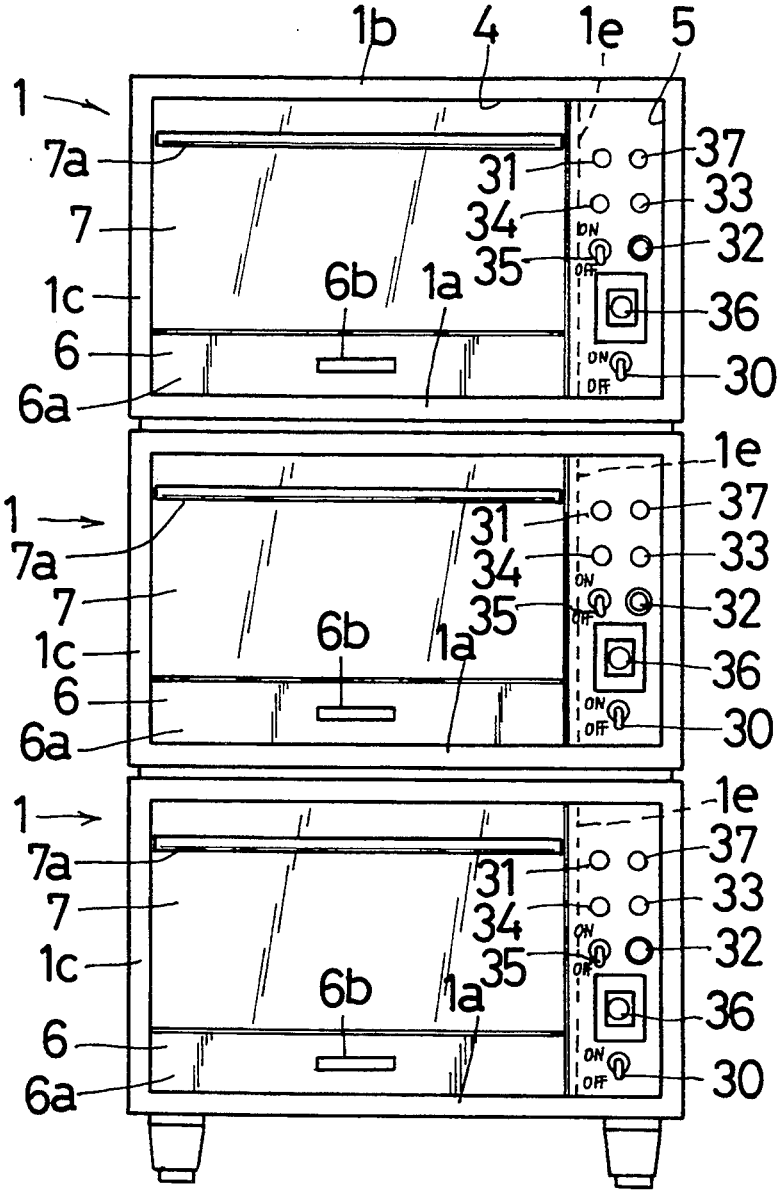
FIG. 4 is a front view snowing the whole of the same embodiment.
Figure 5:
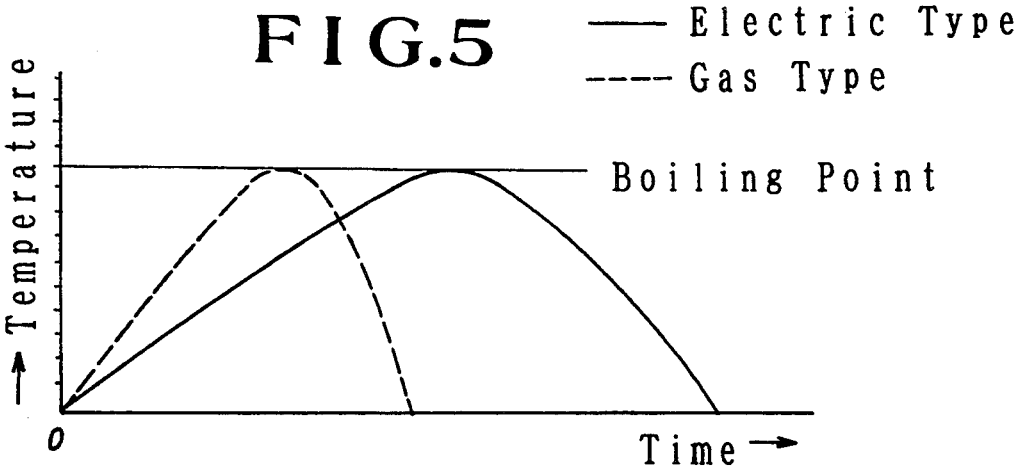
FIG. 5 is graphs showing characteristics of boiling point reaching time and cooling time of a gas type rice oven and an electric type rice oven.

Referring to FIGS. 1, 2 and 4, an oven body 1 (outer frame) is formed in a rectangular shape, defining its front surface as an opening 2, and a bottom wall 1*a*, a top wall 1*b*, left and right walls 1*c*, 1*c*, and a rear wall 1*d* are formed in heat insulating structure, by making each of them in double wall and by interposing therebetween a heat insulator 3 as shown in FIG. 1.

The inside of the oven body 1 a is divided into a cooking chamber 4 having a large volume and extending in the right and left direction and a control chamber 5 having a small volume by a partition wall le which is longitudinally arranged near to the one side of the right and left direction of the oven body 1.

In the lower part of the cooking chamber 4, as shown in FIGS. 1 and 4, a receiving pan 6 is set freely for taking out and putting it in through the opening 2, and in the upper part of the cooking chamber 4, a door 7 having a projected grip 7*a* from its front surface is arranged so as it is able to close in its vertical posture and is able to open to the downward of front part as shown with the solid line and the two-dot chain line in FIG. 1, by pivotally attaching its lower ends of its right and left sides to the side wall 1*a* and the partition wall 1*e* by a pivot 8.

The above-mentioned receiving pan 6 is formed in a drawer-like shape having a size substantially equal to the bottom surface of the cooking chamber 4 with, a front surface plate 6*a* from which a grip 6*b* is projected forward, a bottom plate 6*c*, right and left side plates 6*d*, 6*d* and a rear plate 6*e*, as shown in FIG. 1, and receives boiled-over broths or waterdrops during cooking.

An electrical heater 9 is provided horizontally at the inside lower part of the cooking chamber 4, by remaining therebelow a space through which the receiving pan 6 is put in and taken out.

As shown in FIGS. 1 and 2, heater support angles 10, 10 are attached horizontally to the right and left side walls in the cooking chamber 4, that is, to the inner surfaces of the lower parts of wall 1*c* of one side and the partition wall 1*e*, heater support bars 11, 11 are fixed to the right and left sides of the heater support angles 10, 10 by means of fittings 12 . . . , and the above-mentioned electrical heater 9 is laid on the heater support bars 11, 11.

Further, as shown in FIG. 2, the electrical heater 9 is fixed to the partition wall 1*e* through an insulator 13 and is extended into the above-mentioned control chamber 5, and it is connected to a cord 14 shown in FIG. 1, through a power switch or the like which will be explained later.

Further, in the inner surfaces of the one side wall 1*c* and the partition wall 1*e*, guide rails 15, 15 having a recess shape facing its front surface substantially side ways are fixed longitudinally and parallel in facing each other by screws 18 . . . , and a plurality of rollers 16 . . . are rotatably fixed to the guide rails 15, 15 at predetermined intervals in the longitudinal direction by means of horizontal shafts 17.

A cooking pot 19 is formed in a rectangular plan shape so that it is able to take out from and put into the above-mentioned cooking chamber 4. An outwardly directed flange 20 having an L-like cross-sectional shape is attached to the circumference of the upper edge of the cooking pot 19, and by setting and engaging the horizontal bottom surface 20*a* of the flange 20 on the rollers 16, . . . of the guide rails 15, 15, the cooking pot 19 can be taken out and put in.

As shown in FIGS. 1 and 2, an exhaust hole member 21 having a recess-like cross-sectional shape facing substantially side ways is laterally and horizontally fixed to the upper pare of the inner surface of the rear wall 1*d* of the oven body 1 by means of screws 22, . . . A plurality of exhaust holes 23, . . . are penetrated the exhaust hole member 21 at predetermined intervals in the crosswise direction, and the exaust hole member 21 is communicated to an exhaust pipe 24 set outside of the oven housing 1 by penetrating through the rear wall 1*d* thereof. Thereby the upper pare of the inside of the cooking chamber 4 is always communicated with the outside.

Further, a vent hole 25 formed in the lower part of the middle of the inner surface of the rear wall 1*d* of the cooking chamber 4 side and for decreasing the residual heat of the cooking chamber 4 with a larger size khan that of the exhaust holes 23 is opened, and is communicated with the outside.

The vent hole 25 is opened substantially at the same position as that of the electrical heater 9 so as to facilitate the deaeration of residual heat from the electrical healer 9, and a horizontal flange 26 is projected toward the inside of the cooking chamber 9 on the upper edge of the opening of the vent hole 25.

As shown in FIG. 1, the vent hole 25 is communicated with a duct 27 fixed to the outside part of the rear wall 1*d* of the oven body 1, and in this embodiment, the residual heat of the oven body 1 or the cooking chamber 4 is forcibly decreased by means of a fan 28.

As the forced residual heat decrease system, there are a suction type in which the residual heat is decreased through suction by means of the fan 28 and the blow-in type in which ambient air is forcibly blown into the cooking chamber 4 by means of the fan 28 so that the residual heat is dropped down and removed to the outside through the exhaust holes 23 . . . and the exhaust pipe 24.

Figure 3:
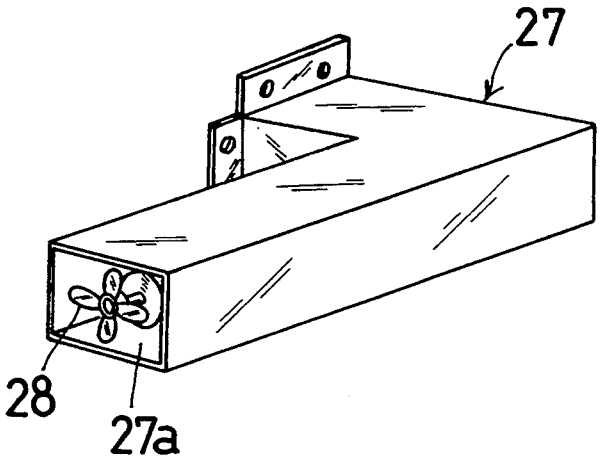
FIG. 3 is a perspective view illustrating a duct in the same embodiment.

The above-mentioned duct 27 is located at the rear wall 1*d* of the oven body 1 and the exhaust pipe 24 is fixed to the rear wall 1*d* above the duct 27. Accordingly, the duct 27 is bent in an L-like plan shape in this embodiment as shown in FIG. 3, so that the residual heat in the cooking chamber 4 is deaerated horizontally. However, the duct 7 may be one bending downward or obliquely upward, or ones extending straight forward and so forth, and it is optione.

The above-mentioned duct 27 is disposed in its communication port 27*a* with the fan 28 together with a motor (not shown) as a power source thereof. However, a pump (not shown) or the like may be used, instead of the fan 28.

As shown in FIGS. 2 and 4, a control panel 29 is provided on the front surface of the control chamber 5 of the oven body 1, and the control panel 29 is provided with, a power source switch 30, a power source lamp 31 which is lit on when the power source switch 30 is turned on, a cooking switch 32, a cooking lamp 33 which is lit on when the cooking switch 32 is turned on, a steaming lamp 34 which is lit on when the cooking lamp 33 is extinguished after completion of the cooking, a buzzer switch 35 for deenergizing a buzzer (which is not shown) which informs the completion of the cooking simultaneously with the putting out the steaming lamp 34 after the steaming time (for example, 30 min.) elapses, a cooking preservation timer 36, and a preservation lamp 37 which is lit on when the cooling preservation timer 36 is set to the time of cooking.

For the rice oven of above-mentioned structure, there are a single stage type as shown in FIG. 2, a double stage type (which is not shown) in which two ovens are vertically stacked one upon another, a vertical three stage type in which three ovens are stacked one upon another as shown in FIGS. 1 and 4.

According to the present invention, as mentioned above, a fan or the like is at once started after the cooking of rice, thereby the residual heat in the oven body is forcibly drawn to the outside by sucking it or by pusing out it through the existing exhaust holes and exhaust pipe after the ambient air is blown into the oven body through the vent hole, so that it is possible to have the temperature of the inside of the oven body abruptly lower, and to control the inside of said oven body into a suitable temperature for steaming. Therefore, the evaporation of moisture can be appropriately restrained, scorching of rice can be prevented during steaming, and further, the steaming can be suitably and sufficiently made, thereby it is possible to cook fluffy, tasty and glossy rice without loss.

What is claimed is:

1. An oven for cooking rice comprising in combination (A) a cooking chamber defined by a top wall (1*b*), a bottom wall (1*a*), side walls (1*c*) and a rear wall (1*d*), (B) electrical heating means (9) mounted in the lower portion of said cooking chamber, (C) guide rails (15) mounted on the opposed side walls (1*c*) above said electrical heating means (9), said guide rails (15) being adapted to support a cooking pot (19) that contains rice and water, (D) exhaust outlets (21) extending through said rear wall (1*d*) in an upper portion thereof adjacent the level of said guide rails (15), said outlets are adapted to remove steam from cooking rice, and (E) fan means for creating airflow within the cooking chamber, (F) an opening (25) in said rear wall (1*d*) at a location which is below said exhaust outlets (21) and adjacent to said electrical heating means (9) for rapidly decreasing the temperature in that area at the conclusion of a cooking cycle by (a) withdrawing heating gases; and (b) blowing in cooler ambient air.

* * * * *